United States Patent [19]

Bishop

[11] Patent Number: 4,925,333

[45] Date of Patent: May 15, 1990

[54] SECTIONAL SHOCK ABSORBING AND MOTORIST WARNING HIGHWAY BARRIERS

[76] Inventor: Robert J. Bishop, 1083 Bloomfield Ave., West Caldwell, N.J. 07006

[21] Appl. No.: 386,984

[22] Filed: Jul. 31, 1989

[51] Int. Cl.[5] ..... E01F 13/00; E01F 15/00

[52] U.S. Cl. ..... 404/6; 404/10

[58] Field of Search ..... 404/6, 9, 10; 256/1, 256/13.1; 40/612

[56] References Cited

U.S. PATENT DOCUMENTS

| | | | |
|---|---|---|---|
| 4,447,802 | 5/1984 | Böse | 40/612 |
| 4,498,803 | 2/1985 | Quittner | 404/6 |
| 4,502,812 | 3/1985 | Zucker | 404/6 |
| 4,681,302 | 7/1987 | Thompson | 256/13.1 |
| 4,773,629 | 9/1988 | Yodock | 256/13.1 |
| 4,822,208 | 4/1989 | Ivey | 256/13.1 |
| 4,854,767 | 8/1989 | Sasaki | 404/6 |

*Primary Examiner*—Stephen J. Novosad
*Assistant Examiner*—Gay Ann Spahn
*Attorney, Agent, or Firm*—Howard E. Thompson, Jr.

[57] ABSTRACT

A sectional shock-absorbing and motorist warning highway barrier is provided in the form of multi-component sections about four feet in length, and adapted to be joined together in end-to-end relation to form a continuous barrier, each section being made up of four vertically aligned horizontal components, providing a top component, and two mid-components of uniform thickness, and a flared bottom component, such components having offsets at opposed ends thereof for aligning successive sections with such offsets having transverse apertures for receiving bolts in securing together successive sections, abutting surfaces of the horizontal components having aligned offsets of semi-spherical contour to receive spherical plastic bumper members protrudingly and rotatably supported in the assembled section. The horizontal components are fashioned from concrete, suitably encased in plastic shells, and the spherical plastic bumper members may be either air filled, or filled with water or sand for added weight. The offsets for aligning successive sections are for direct section-to-section engagement, or for reception of vertically oriented, and suitably flexible interfitting connecting members. With either type of section-to-section connections the free ends of a multi-sectional assemblage are provided with appropriately contoured vertical connecting members interfitting with the aligning offsets, preferably including means providing visibility enhancement.

19 Claims, 3 Drawing Sheets

FIG 7
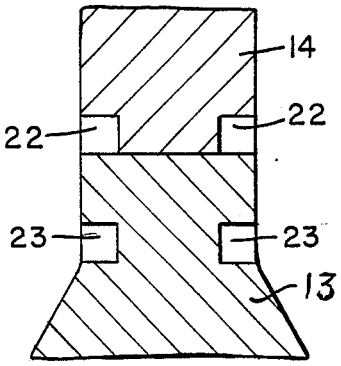
FIG. 8
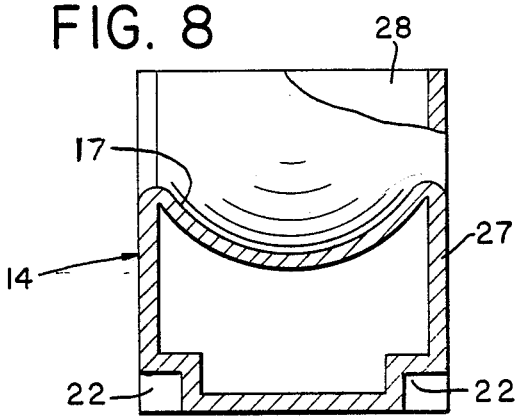
FIG. 10
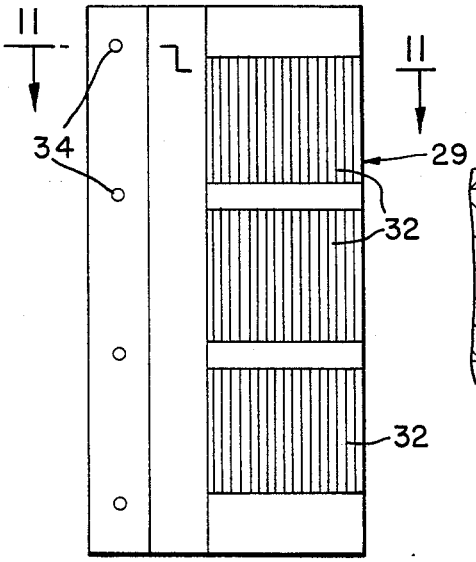
FIG. 11
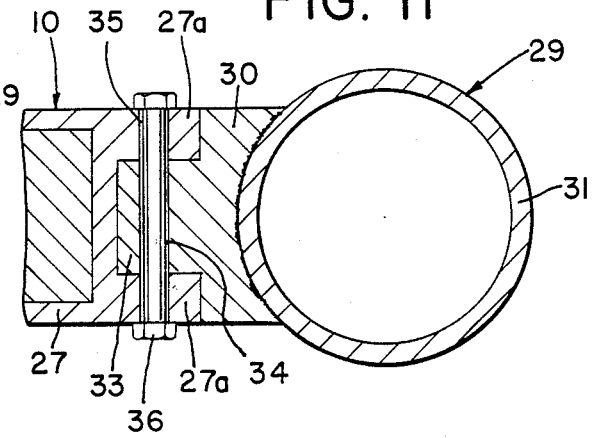
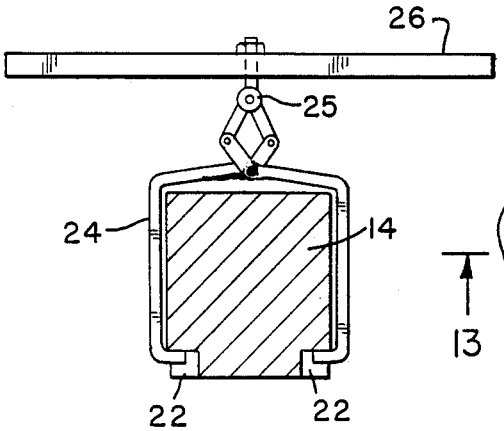
FIG. 9
FIG. 12
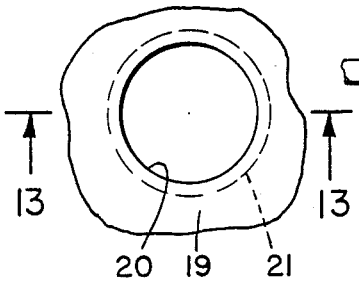
FIG. 13
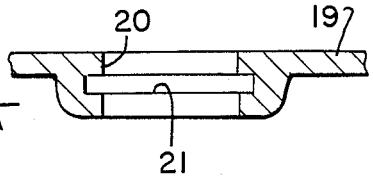

SECTIONAL SHOCK ABSORBING AND MOTORIST WARNING HIGHWAY BARRIERS

This invention relates to an improved highway barrier for use as a highway divider and/or protective means along construction sites which is of sectional construction with aligned recesses receiving movable and deformable inserts protruding from opposed surfaces thereof as shock absorbing elements, with the longitudinal spacing of such inserts providing a motorist warning signal as a moving vehicle establishes glancing contact with the barrier.

BACKGROUND OF THE INVENTION

It has long been the practice in providing highway dividers and protective screenings along construction sites to employ elongated concrete members having relatively upstanding portions and flared supporting base aligned in end-to-end relation to form an essentially continuous barrier in the area needed. The preformed sections, generally fabricated from concrete and about sixteen feet in length, are extremely heavy, requiring special equipment for transport to location and relocation. While quite durable as both highway dividers and screens for construction sites, these sectional highway barriers leave much to be desired in many respects. While relatively indestructible when installed as highway divider, such barriers, when used as protective screening along construction sites, are easily damaged when being moved from place to place, and frequently must be discarded and replaced after five or six moves to different construction locations.

Highway barriers of the type described, while effectively guiding motorists in high speed travel along busy highways can cause serious damage to vehicles coming in contact with them, and they have been the cause of many serious and sometimes fatal accidents due to loss of control of moving vehicles when contacting the barriers. Furthermore, the relatively narrow profile of the barrier ends makes them difficult to see in various weather conditions, and many accidents have been experienced involving head-on impact with the barrier ends.

It follows from the foregoing that both from the standpoint of installation and maintenance, and the standpoint of motorist safety, there is need for improvement in ways of providing highway barriers and protective screens for highway construction sites.

THE INVENTION

In accordance with the present invention the problems above described can be essentially overcome by providing a sectional shock-absorbing and motorist warning highway barrier in the form of multi-component sections about four feet in length, and adapted to be joined together in end-to-end relation to form a continuous barrier, each section being made up of four vertically aligned horizontal components, providing a top component, and two mid-components of uniform thickness, and a flared bottom component, such components having offsets at opposed ends thereof for aligning successive sections with such offsets having transverse apertures for receiving bolts in securing together successive sections, abutting surfaces of the horizontal components having aligned offsets of semi-spherical contour to receive spherical plastic bumper members protrudingly and rotatably supported in the assembled section. The horizontal components are fashioned from concrete, suitably encased in plastic shells, and the spherical plastic bumper members may be either air filled, or filled with water or sand for added weight. The offsets for aligning successive sections can be for direct section-to-section engagement, or for reception of vertically oriented, and suitably flexible, interfitting connecting members. With either type of end-to-end connection the free ends of a multisectional assemblage are provided with appropriately contoured vertical connecting members interfitting with the aligning offsets, preferably including means providing visibility enhancement.

The fabricating of the horizontal components of the sectional barrier from concrete presents something of a problem due to the intricate mold configurations required, and the number of molds which would be needed at a production site, even when using quick setting concrete. This problem can be overcome by molding relatively thin walled plastic shells having five walls, and open along one horizontal surface to permit filling with concrete. The use of such plastic shells would greatly facilitate quantity filling at a production site, having means for storage of the filled components as the concrete sets. Alternatively, the use of the plastic shells permits these shells to be delivered to a highway use location, and to be filled with concrete during initial installation and assemblage of the highway barrier.

Each of the horizontal components or the plastic shells defining such components is provided, at opposed lower edges and adjacent ends thereof, with undercuts permitting engagement by appropriately contoured tongs to facilitate mechanical or manual lifting of the horizontal components.

A primary advantage of the new barrier construction is that the assembly and disassembly operations can readily be performed with light mechanical equipment, or by manual lifting. For manual lifting, it is envisioned that tongs anchored centrally on elongated bars at opposed ends of a component would enable four men to easily lift and relocate the concrete components.

The assembly steps for assembling each section of the barrier are really quite simple. After properly aligning the base section, the plastic balls are placed in the depressions therein, and serve to guide the placement of the second section, having recesses interfitting with the spaced balls. With the second section in place, balls are inserted in the depressions, and the third section lowered thereover, with these steps being repeated in location of the top section.

Care must be taken to properly align the contoured ends of the horizontal components to interfit with the vertical connecting members or end pieces on a barrier assemblage so that bolts can be passed through the interfitting portions in making the assemblage.

In a modified form of construction, the bolts extending transversely of the interengaged parts may be omitted and replaced by a saddle member straddling adjacent top components and secured thereto by vertically disposed balls.

The plastic balls which protrude a substantial distance from aligned surfaces of the horizontal components can be filled with air, suitably under pressure, or with water or sand, if added weight is desired. Regardless of the fill the plastic balls will be rotatable in the sockets provided, and will have a shock absorbing resilience not shared by the concrete structure itself. Thus a glancing contact with the protruding balls is unlikely to seriously damage a moving vehicle; and the sound being generated as a vehicle establishes glancing contact with the spaced balls can alert the motorist of the danger in time to permit steering away from the barrier before contact is established with the rigid concrete structure.

This combination of a shock absorbing protrusion from the barrier, and the ability to generate a warning sound has the potential, it is believed, of greatly reducing the number of accidents in which contact with highway barriers will result in serious damage, injury, or death.

It is contemplated that the plastic balls will be characterized as to color, so as to provide enhanced visibility to the day-time or the night-time motorist, thus further adding to safety afforded by the new barrier construction. In line with this, the end pieces will suitably be provided with resilient plastic cylinders of a diameter corresponding with the diameter of the balls, and having color bands in alignment with the balls, providing enhanced visibility in both day-time and night-time driving. The resilient structure and enhanced visibility of the barrier ends thus provide a further factor of safety in the improved barrier.

Novel features of the improved highway barrier will be more readily understood from a consideration of the accompanying drawings illustrating preferred adaptations of the invention, in which the various parts thereto have been identified with suitable reference characters in the several views, and in which.

Figure 4:
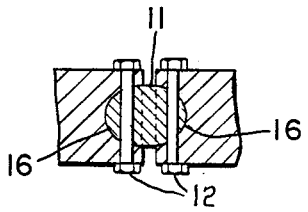
FIG. 4 is a fragmentary sectional view substantially on the line 4—4 of FIG. 1.
Figure 5:
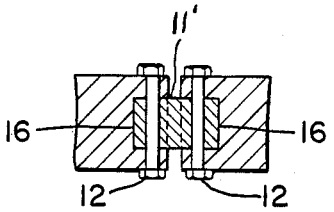

FIG. 5 view similar to FIG. 4 showing a modification.

Figure 1:
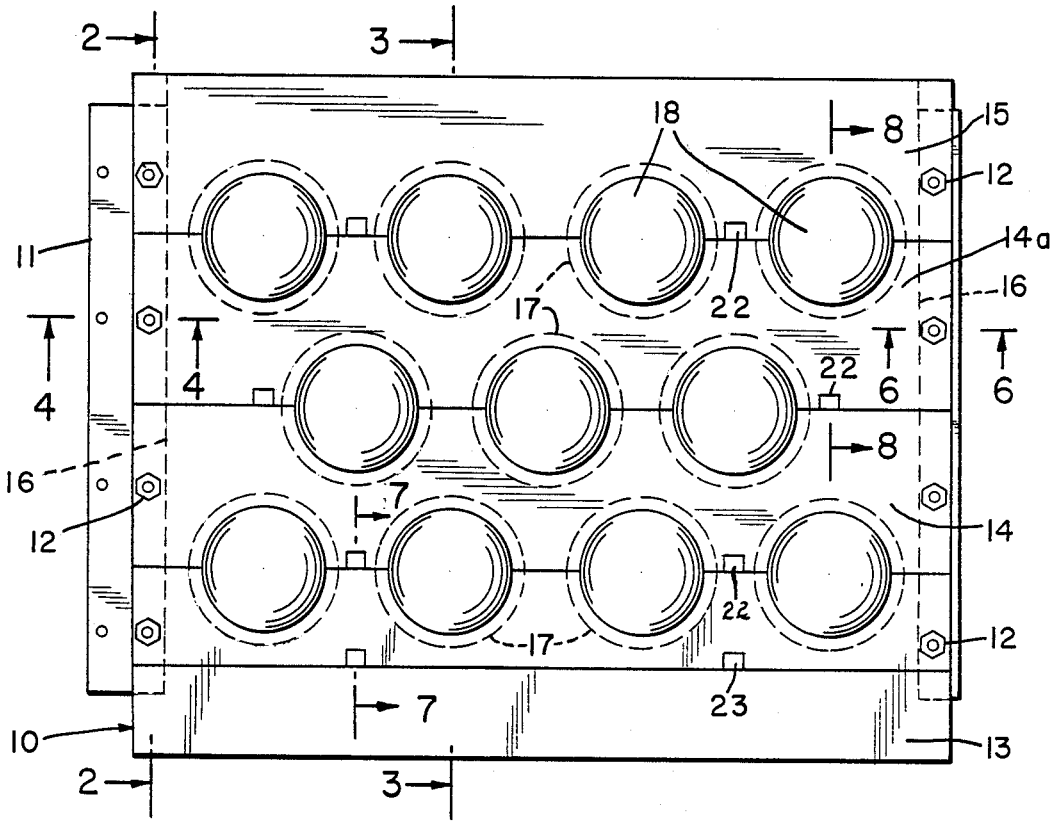
FIG. 1 is a side elevation view of a 4-component section of the improved barrier with interconnecting and end closure means illustrated.
Figure 6:
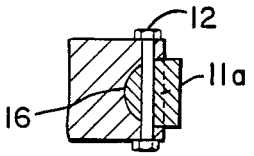

FIG. 6 is a fragmentary sectional view substantially on the line 6—6 of FIG. 1.

FIG. 7 is a fragmentary sectional view substantially on the line 7—7 of FIG. 1.

FIG. 8 is a fragmentary sectional view substantially on the line 3–8 of FIG. 1, and illustrating the plastic shell modification before filling with concrete.

FIG. 9 is a diagrammatic view of the tong means used in lifting members as illustrated in FIGS. 7 and 8.

FIG. 10 is a side elevation view of a modified form of end closure.

FIG. 11 is a sectional view substantially on the line 11—11 of FIG. 10 illustrating association with a sectional component encased in plastic.

Figure 2:
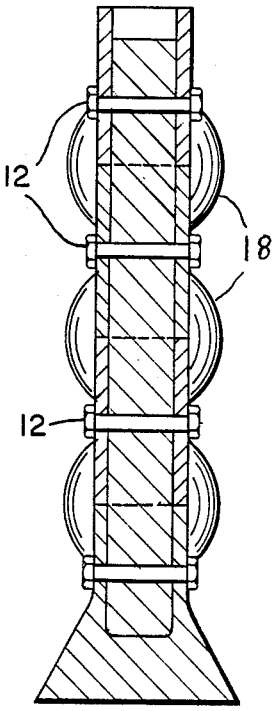
FIG. 2 is a sectional view substantially on the line 2—2 of FIG. 1.
Figure 3:
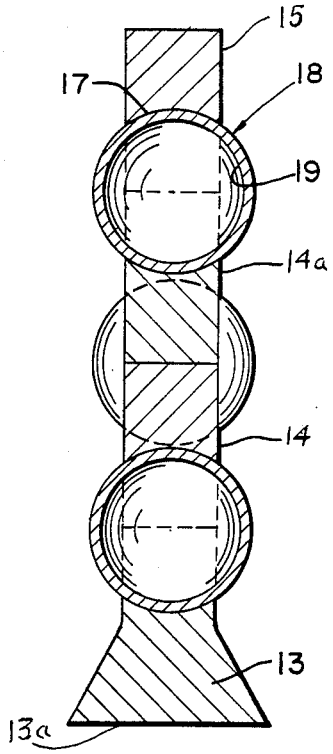
FIG. 3 is a sectional view substantially on the line 3—3 of FIG. 1

FIG. 12 is a fragmentary view of a portion of one of the balls shown in FIGS. 1, 2 and 3 illustrating a preformed filling aperture therein.

FIG. 13 is a sectional view on the line 13—13 of FIG. 12.

Figure 14:
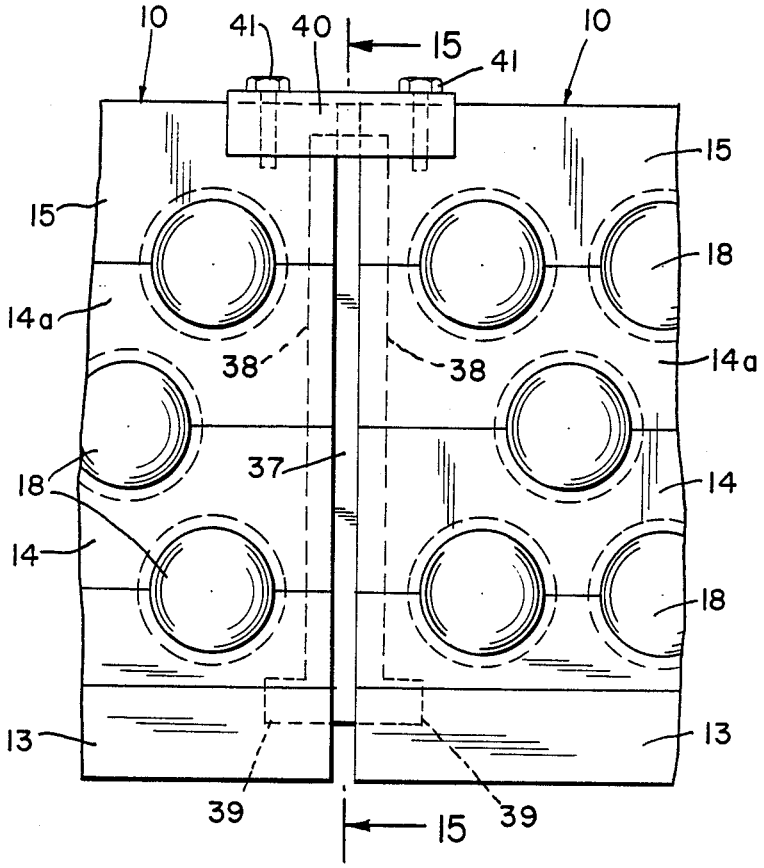

FIG. 14 is a fragmentary view similar to FIG. 1, showing a modified form of connecting means between barrier sections.

Figure 15:
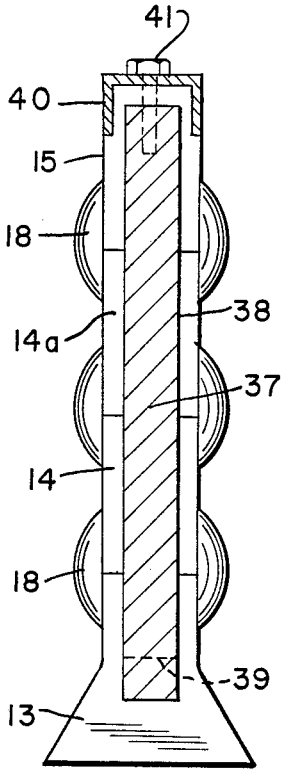

FIG. 15 is a sectional view substantially on the line 15—15 on FIG. 14; and

Figure 16:
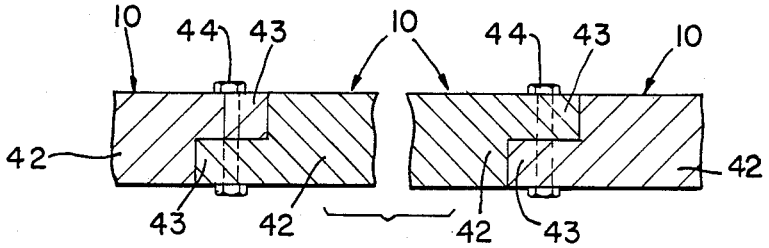

FIG. 16 is a fragmentary sectional view similar to FIGS. 4, 5 and 6 illustrating a modified structure in which successive sections have interfitting ends permitting direct coupling, and eliminating the need for interposed connecting members.

As shown in FIGS. 1–7 of the drawing one section 10 of a multi-section highway barrier as illustrated in association with a typical connecting member 11 and typical end closure member 11*a*. The section 10 is made up of four horizontally disposed and vertically aligned components comprising a flared base component 13, a lower intermediate component 14, an upper intermediate component 14*a* and a top component 15.

These components are fashioned from concrete preformed to have depressions 16 at the ends thereof to interfit with connecting members 11 or end members 11*a*, as shown in FIGS. 4 and 6. The depressions 16 can be of curved contour to engage correspondingly curved connecting members 11 or end members 11*a*; but it will be noted that the depressions and interengaging parts can have other contours such as the rectangular contours 16' and 11' as shown in FIG. 5. Regardless of the interfitting contours, the parts are joined together by bolts 12 as illustrated.

As shown in FIGS. 1 to 3 of the drawing, the bottom 13*a* of the flared base 13 is about twice as great as the surface to surface thickness of the components 14, 14*a* and 15. It will be understood, however, that for optimum stability in intended uses of the barrier, the dimension 13*a* may be substantially increased suitably to about three times the surface to surface thickness of the components 14, 14*a* and 15.

In general, a relatively narrow base dimension may be appropriate along construction sites where highway travel is at reduced speed, whereas the broader base dimension will be more appropriate for use in lane dividers of high-speed highways.

Abutting surfaces of each of the components 13, 14, 14*a* and 15 are provided with a plurality of semi-spherical depressions 17 aligned to collectively form recesses of spherical curvature to rotatably receive ball members 18. The ball members 18 are plastic shells 19 as shown in FIG. 3 adapted to be filled with air, or with water or sand if added weight is desired. As shown in FIGS. 12 and 13, the plastic shell 19 is preformed with an opening 20 having an undercut 21 for interfitting with a closure plug which will suitably be cemented in place. When it is intended that the plastic shell be air filled, the closure plug will carry conventional valve means permitting inserting air to a desired pressure.

Whether filled with air, water or sand, the ball members 18 will be rotatable in the supporting sockets and will be providing shock absorbing resilience to contact by a moving vehicle. This shock absorbing resilience will minimize vehicle damage when initially contacting the barrier; and it will be noted that the sound generated as a moving vehicle strikes a number of spaced balls 18 will alert the motorist to impending danger in time to generally permit steering away from the barrier before vehicle contact is established with the rigid concrete structure.

As shown in the drawing, four balls 18 have been shown between components 13 and 14, and between components 14*a* and 15, and three interspaced balls 18 have been shown between components 14 and 14*a*. This arrangement has the advantage, by providing balls in spaced groups of three, of giving the motorist something comparable to an 'sos' audible signal.

On the other hand, the level of the interface between components 14 and 14*a* corresponds quite closely with the level at which most passenger vehicles would establish initial contact with the barrier. Thus it could be desirable to have the larger number of balls 18 at this level by substituting a 3-4-3 staggered arrangement of balls for the 4-3-4 arrangement shown in FIG. 1.

To facilitate assembly and disassembly of the barrier sections the horizontal components 14, 14*a* and 15 are provided with opposed notches 22 in the lower edges thereof at positions appropriately spaced from the end, and the base component 13 is provided with corresponding opposed recesses 23 for engagement by mechanically or manually operated lifting tongs. As shown in FIG. 9, the notches 22 of horizontal component 14 are engaged by appropriately contoured tongs 24 secured at 25 centrally of an elongated rod or handle member 26. With the tongs 24 and associated handle member 26 in engagement with notches 24 at opposed ends on the transverse component 14, it will be apparent that four men can easily lift and move about the component 14 and other horizontal components in assembly and disassembly of the barrier sections. Alternatively, the two sets of tongs 24 can be collectively engaged by conventional power lifting means to facilitate quicker and easier assembly and disassembly operations.

The horizontal components 13, 14, 14*a* and 15 can be fashioned from concrete, using conventional re-usable molds of multi-component construction. This approach has limitations, however, because of the substantial time required for the concrete to cure sufficiently to permit removal of the mold components. To overcome this problem, a preferred adaptation of the invention involves first, pre-forming shell structures from plastic material which are closed on five sides and open at the sixth side to act as molds which become part of the finished product. This modification is illustrated in FIG. 8 where horizontal component 14 is shown as comprising plastic shell 27 fashioned to include all surface contours, including the notches 22 and the semispherical depressions 17, but being open at the top surface as indicated at 28 to permit filling with concrete.

Such plastic shells can be used at a central concrete fabricating station, having means for storage of filled shells during the curing process. Alternatively, the shells can be delivered directly to an initial highway use site and filled with concrete by the contractor in charge of the initial barrier installation. This has the advantage of permitting practical manual assembly of barrier sections in initial erection of a highway barrier.

The plastic shell construction has a further advantage of permitting color characterization of the shell material.

As illustrated in FIGS. 10 and 11 of the drawing the simple type end member 12 shown in FIGS. 1 and 6 can be replaced by a composite end member 29, suitably fashioned from plastic material and comprising a contoured mounting member 30 to interfit with assembled components of barrier section 10 and to receive and support an enlarged cylindrical member 31, suitably of a diameter approximately equivalent to the diameter of the balls 18. The cylindrical member 31 is of a height corresponding with the height of the barrier section 10 and is suitably positioned by cementing to the contoured portion of member 30. Thus, the composite end member 29 will provide a profile of enhanced visibility for the motorist approaching the end of a highway barrier; and the effective visual signal can be enhanced by providing bands of color 32 in alignment with the rows of ball members 18 supported in the barrier sections.

The cylindrical portion 31 of end member 29 can be open-ended with the wall thickness and composition of the plastic material being such as to provide resilient deformability in the event of impact on the cylindrical member 31 by a moving vehicle. If desired, however, the ends of the cylindrical member 31 can be closed and provided with an air valve, permitting the insertion of air under pressure to enhance the resilient deformability in the event of impact.

The portion 33 of mounting member 30 which interfits with components of barrier sections 10 has appropriately spaced apertures 34 aligning with apertures 35 in the barrier section component to receive elongated bolts 36.

When the horizontal components of barrier section 10 are of the filled shell construction shown in FIG. 8 and in the fragmentary illustration in FIG. 11, the shell 27 will properly include extensions 27*a* carrying the aperture 35 for receiving bolts 36.

FIGS. 14 to 16 are presented to diagramatically indicate alternative means for the end-to-end joining of barrier sections 10. The lead for numerous transverse connecting bolts can be eliminated by employing between successive barrier sections 10 vertical aligning members 37 interfitting with recesses 38 in horizontal components 13, 14, 14*a* and 15 with positioning extensions 39, engaging the base components 13; and securing together the tops of adjacent sections 10 by three-sided saddle members 40 positioned with respect to top components 15 by two bolts 41. If desired, the top components 15 can be appropriately recessed as shown in FIG. 15 for receiving the saddle members 40 in a manner to be substantially flush with surfaces of the barrier sections 10.

In the further modification shown in FIG. 16 the need for connecting or aligning members between sections 10 can be eliminated by forming ends of the horizontal components 42 with half thickness overlapping offsets 43 apertured to receive connecting bolts 44. It will be noted that this modification requires only half the number of connecting bolts shown in FIGS. 1 to 6 in addition to eliminating the need for any separate and interfitting connecting or aligning member.

With either of the modifications shown in FIGS. 14 to 16, it will be apparent that end members on the first and last of a series of assembled sections 10, whether of the plain type shown in FIG. 6 or the composite type shown in FIGS. 10 and 11, will require appropriate contouring for interfitting with and to the sections 10.

Various changes and modifications in the shock absorbing and motorist warning highway barriers herein disclosed may occur to those skilled in the art; and to the extent that such changes and modifications are embraced by the appended claims, it is to be understood that they constitute part of the present invention.

I claim:

1. A sectional shock-absorbing and motorist warning highway barrier comprising multi-component sections about four feet in length, and adapted to be joined together in end-to-end relation to form a continuous barrier, each section being made up of four vertically aligned horizontal components, providing a top component and two mid-components of uniform thickness, and a flared bottom component, such components having offsets at opposed ends thereof for aligning successive sections, with such offsets having transverse apertures for receiving bolts in securing together successive sections, abutting surfaces of the horizontal components having aligned offsets of semi-spherical contour to receive spherical plastic bumper members protrudingly and rotatably supported in the assembled section, the horizontal components being fashioned from concrete, suitably encased in plastic shells, the spherical plastic bumper members being of hollow structure having means for filling with compressed air, or for filling with water or sand for added weight, the offsets for aligning successive sections being for direct section-to-section engagement, or for reception of vertically oriented, and suitably flexible interfitting connecting members, and with either type of section-to-section connections the free ends of a multi-component sections being provided with appropriately contoured vertical connecting members interfitting with the offsets for aligning successive sections.

2. A sectional highway barrier as defined in claim 1, wherein horizontal components are completely fashioned from molded concrete.

3. A sectional highway barrier as defined in claim 1, wherein the horizontal components are fashioned from preformed, thin-walled, 5-sided plastic shells defining surface contours of such components, and being open on a sixth side to permit filling with concrete.

4. A sectional highway barrier as defined in claim 3 wherein the plastic shells defining said horizontal components constitute separate articles of manufacture adapted for alternative use as molds at a central concrete filling site, or as members to be filled at the site of an initial highway barrier installation.

5. A sectional highway barrier as defined in claim 3 wherein the aligning offsets of opposed ends of said horizontal components comprise extensions of the plastic material of said shells.

6. A sectional highway barrier as defined in claim 1 wherein said horizontal components have widely spaced undercuts in lower portions of opposed vertical surfaces, providing means for easy engagement of said components with manually or mechanically operated lift tongs.

7. A sectional highway barrier as defined in claim 1 wherein the flared base component has a transverse dimension at its lower extremity which is two to three times the transverse dimension of said other horizontal components.

8. A sectional highway barrier as defined in claim 1 wherein the vertical connecting members at the free ends of a multi-sectional assembly are aligned with, and do not protrude beyond the transverse dimension of the assembled sections.

9. A sectional highway barrier as defined in claim 1 wherein the vertical connecting members at the free ends of a multi-sectional assembly are aligned with the assembled sections and include a vertically disposed resilient cylindrical extension having a diameter approximately equivalent to the diameter of said spherical plastic bumper members.

10. A sectional highway barrier as defined in claim 9 wherein said vertically exposed cylindrical extensions are of plastic construction and include means for filling with compressed air or water to provide resilient deformability.

11. A sectional highway barrier as defined in claim 9 wherein said vertically disposed cylindrical extension includes vertically spaced bands of color aligned with said spherical plastic bumper members, with the color being consistent with the color of said bumper members.

12. A sectional highway barrier as defined in claim 1 wherein the ends of said horizontal components are so fashioned as to permit direct interfit and engagement between successive barrier sections.

13. A sectional highway barrier as defined in claim 1 wherein the ends of said horizontal components are fashioned to receive interfitting connecting members vertically disposed between successive barrier sections.

14. A sectional highway barrier as defined in claim 13 wherein said connecting members and horizontal components of adjacent sections are integrally joined together by bolts passing therethrough.

15. A sectional highway barrier as defined in claim 13 wherein the vertical connecting members are held in interlocked relation with successive barrier sections by three-sided channel members fitting over the juncture between top horizontal components of adjacent sections which are secured in place by vertically disposed bolts engaging said top components.

16. A sectional highway barrier as defined in claim 15 wherein said top horizontal components are recessed at abutting end portions to receive three-sided channel members having outer surfaces aligned with outer surfaces of said top components.

17. A sectional highway barrier as defined in claim 1 wherein the spherical plastic bumper members are arranged in alternating odd and even numbers at successive interfaces between said horizontal components.

18. A sectional highway barrier as defined in claim 17 wherein the numbers of bumper members at said interfaces provides a top to bottom pattern of 3-4-3.

19. A sectional highway barrier as defined in claim 17 wherein the numbers of bumper members at said interfaces provide a top to bottom pattern of 4-3-4.

* * * * *